US005447101A

United States Patent [19]

Weis

[11] Patent Number: 5,447,101

[45] Date of Patent: Sep. 5, 1995

[54] PRINTING UNIT FOR A ROTARY PRINTING PRESS

[75] Inventor: Anton Weis, Lorsch, Germany

[73] Assignee: Albert-Frankenthal Aktiengesellschaft, Frankenthal, Germany

[21] Appl. No.: 361,287

[22] Filed: Dec. 22, 1994

[30] Foreign Application Priority Data

Dec. 24, 1993 [DE] Germany ..... 43 44 365.6

[51] Int. Cl.[6] ..... B41F 5/04; B41F 31/34

[52] U.S. Cl. ..... 101/219; 101/247

[58] Field of Search ..... 101/216, 218, 219, 220, 101/221, 222, 223, 247, 178, 180, 181, 182, 184, 185, 351, 352

[56] References Cited

U.S. PATENT DOCUMENTS 2,051,573 8/1936 Quick et al. ..... 101/221

FOREIGN PATENT DOCUMENTS 234456 2/1987 European Pat. Off. .

0234456 2/1987 European Pat. Off. .

1436532 11/1970 Germany .

*Primary Examiner*—J. Reed Fisher

*Attorney, Agent, or Firm*—Jones, Tullar & Cooper

[57] ABSTRACT

A printing unit for a rotary printing press, and that is capable of accomplishing a flying printing change, uses a single counter-pressure cylinder and two printing cylinders and ink application rollers. The counter-pressure cylinder and the ink application rollers are shiftably supported with respect to the printing cylinders. They also carry eccentric support disks that engage concentric support disks or the printing cylinders. These disks are usable to adjust the contact force between the cylinders to compensate for printing plate wear.

7 Claims, 2 Drawing Sheets

PRINTING UNIT FOR A ROTARY PRINTING PRESS

FIELD OF THE INVENTION

The present invention is directed generally to a printing unit for a rotary printing press. More particularly, the present invention is directed to a printing unit which has two printing cylinders and two ink application rollers and with a single counter-pressure cylinder. Most specifically, the present invention is directed to a printing unit which is able to perform a flying change in printing. This flying printing change is accomplished by shifting the engagement of the counter-pressure cylinder between the two printing plate cylinders. The counter-pressure cylinder is supported by eccentric bushings from a housing. The counter-pressure cylinder, the two printing plate cylinders and the two ink application rollers each carry at least one support disk at both ends of the shaft journals for each of the respective cylinders.

DESCRIPTION OF THE PRIOR ART

It is generally known in the art to provide printing units that allow a so-called flying printing change. In such devices there are provided two printing plate cylinders and at least one counter-pressure cylinder. The flying printing change is accomplished by placing the counter-pressure cylinder into printing engagement with one of the printing plate cylinders while taking it out of engagement with the other printing plate cylinder.

In the European Patent Publication EPO 234 456 A 2 there is shown an auxiliary printing unit for use, for example in flexographic printing. This printing unit is called an "imprinter" and can accomplish a flying printing change. This prior art device includes two printing cylinders which are supported between the side frames of the press. An anilox or ink application cylinder is associated with each of the two printing cylinders and each of the two ink application cylinders has an ink application device. Each anilox cylinder can be brought separately into contact with its associated printing cylinder. A single counter-pressure cylinder is pivotably seated so that it can be brought into contact with either one of the two printing cylinders. In operation, only one printing cylinder, together with its associated anilox cylinder and ink application device, is in operative contact with the counter-pressure cylinder at any time. The second printing cylinder, which is not in operation, can be cleaned or replaced.

A limitation of prior art printing units that are usable to accomplish flying printing changes is that it is not possible to completely eliminate bending vibrations that occur in the course of operation of the printing unit. In flexographic printing, which typically uses soft printing plates, these bending vibrations are apt to be particularly problematic. Such bending vibrations give rise to printing quality reductions and generally have a negative effect on printing quality.

There is a need for a printing unit which will accomplish a flying printing change while not sacrificing printing quality. The printing unit for a rotary printing press in accordance with the present invention provides such a device and is a significant improvement over the prior art.

SUMMARY OF THE INVENTION

It is an object of the present invention to provide a printing unit for a rotary printing press.

Another object of the present invention is to provide a printing unit having two printing cylinders and two ink application cylinders with a single counter-pressure cylinder.

A further object of the present invention is to provide a printing unit which is able to perform a flying printing change.

Yet another object of the present invention is to provide a printing unit which is able to act as an "imprinter"

Still a further object of the present invention is to provide a printing unit which facilitates smooth and free-of-play contact between the various cylinders.

Even yet another object of the present invention is to provide a printing unit which will operate in a vibration free manner.

As will be discussed in greater detail in the description of the preferred embodiment which is presented subsequently, the printing unit in accordance with the present invention is able to accomplish a flying printing change by shifting a counter-pressure cylinder between engagement positions with first and second printing cylinders. Each printing cylinder has a screen roller associated with it and each screen roller or ink application roller has an ink supply device. The two printing cylinders are each supported at their ends in the side frames of the press and each printing cylinder carries two spaced support disks on shaft journals at both ends of the cylinder. The two ink application rollers are supported by carriages at either end and each carry an eccentric support disk on its shaft journals intermediate the carriage and the end of the ink application roller. The eccentric support disks are rotatable by gears and motors to shift the position of the ink application rollers. The counter-pressure cylinder is supported at the ends of its shaft journal by eccentric bushings that are carried by pivotable holders. The shaft journals of the counter pressure cylinder also carry two eccentric support disks at each end. These eccentric support disks are rotatable by the operation of motor driven gears. The counter-pressure cylinder can be shifted into engagement with either one of the two printing cylinders. In addition, the forces between the printing cylinders, their respective ink application rollers and the counter-pressure cylinder can be adjusted by rotation of the eccentric support disks.

The printing unit for a rotary printing press in accordance with the present invention overcomes a number of the limitations of the prior art devices. It allows the rapid, free-of-play placement of the counter-pressure cylinder and the ink application rollers against the printing cylinder to be accomplished. A smooth adjustment of the contacting cylinders can take place, even while the printing unit is in operation. This is because the effect of a force on a support disk of the printing cylinder takes place only in one direction. When flexible-letter press printing plates in particular are used on the printing cylinders, it is necessary to be able to adjust the relative positions of the cylinders to compensate for wear of the printing plates. The printing unit in accordance with the present invention allows this adjustment to be accomplished and also prevents the effects of so-called "channel run-outs". The printing format of the printing units can be changed because of the ability to exchange the printing cylinders that are fixed on the frame.

The printing unit for a rotary printing press in accordance with the present invention overcomes the limitations of the prior art devices. It is a substantial advance in the art.

BRIEF DESCRIPTION OF THE DRAWINGS

While the novel features of the printing unit for a rotary printing press in accordance with the present invention are set forth with specificity in the appended claims, a full and complete understanding of the invention may be had by referring to the detailed description of the preferred embodiment which is presented subsequently, and as illustrated in the accompanying drawings, in which:

DETAILED DESCRIPTION OF THE PREFERRED EMBODIMENT

Figure 1:
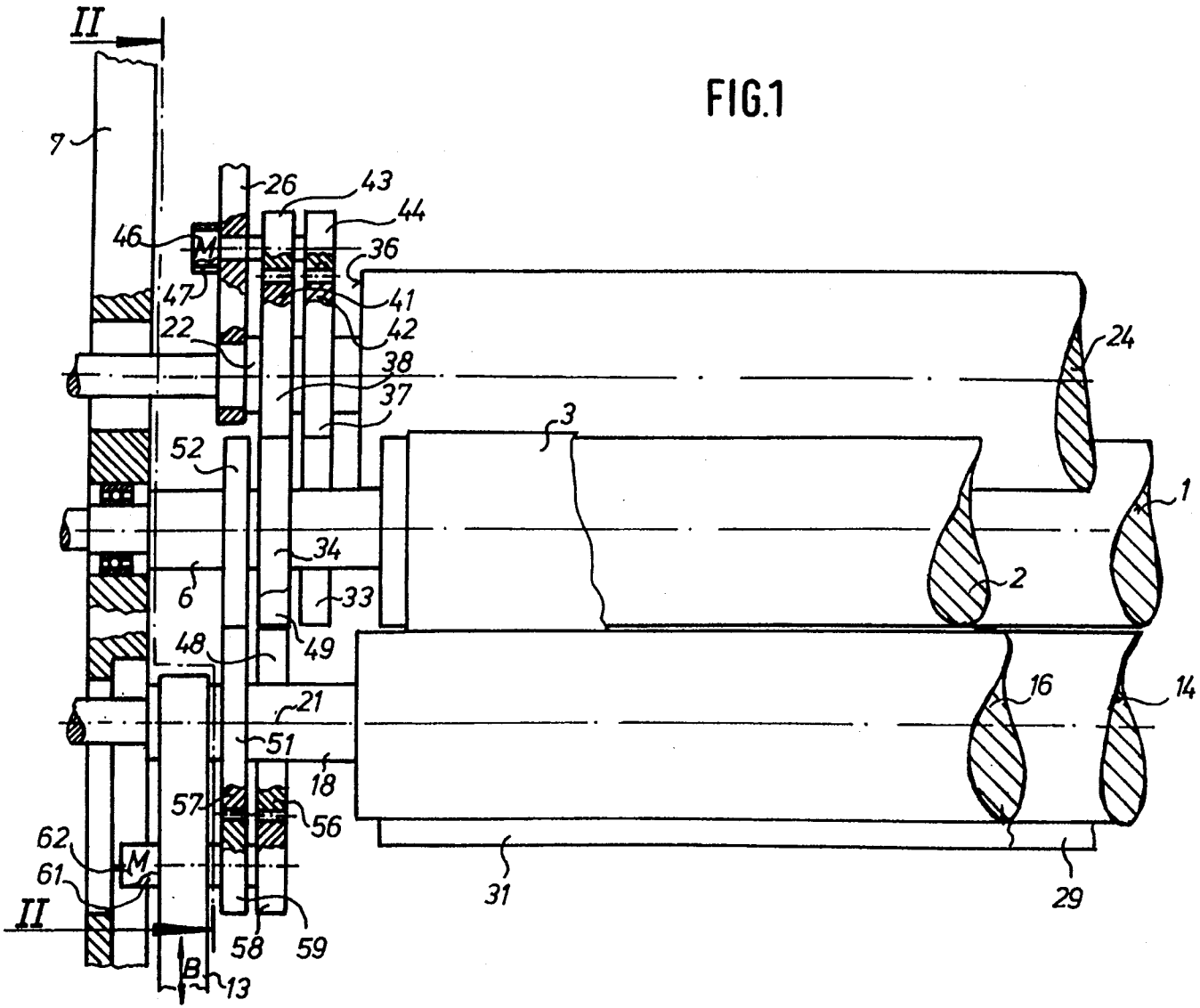
FIG. 1 is a front elevation view of a portion of a printing unit in accordance with the present invention.
Figure 2:
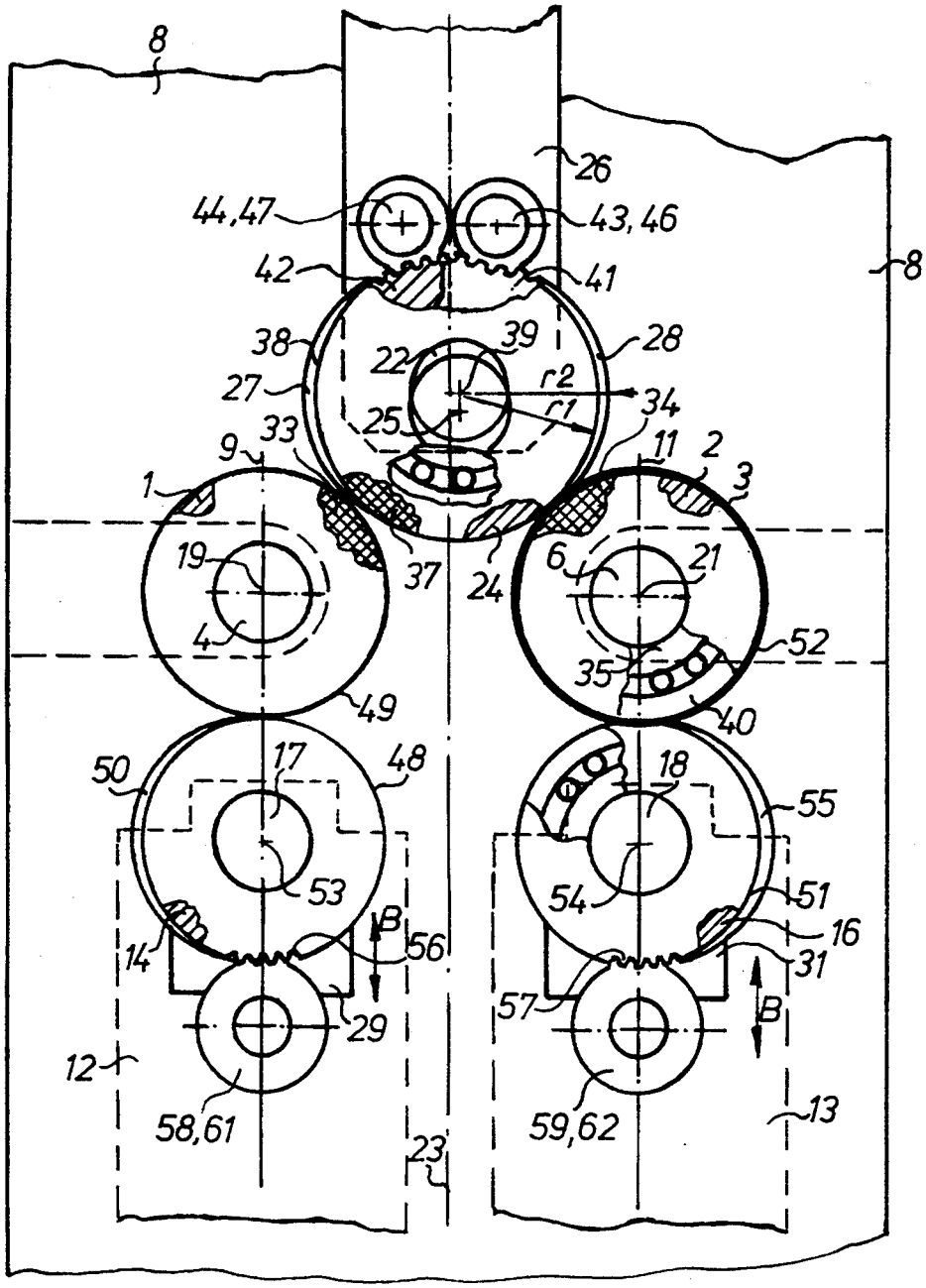
FIG. 2 is a side elevation view, partly in section of the printing press and taken along line II—II of FIG. 1.

Turning initially to FIG. 1, and taken in conjunction with FIG. 2, there may be seen a preferred embodiment of a printing unit for a rotary printing press in accordance with the present invention. It will be understood that only one end of the printing unit is depicted in FIGS. 1 and 2 and that the second end of the printing unit is structured and operates in the same manner and for the same purpose as will be discussed in connection with the portion of the printing unit depicted in FIGS. 1 and 2. It will further be understood that the printing unit is a part of a generally conventional and well known rotary printing press. The remainder of the printing press forms no part of the present invention and is not specifically disclosed or discussed.

As may be seen in FIG. 1, two printing cylinders 1 and 2, which each receive one or more flexible printing plates 3, are supported by means of their shaft journals 4 and 6 in side frames 7 and 8 of a rotary printing press. These shaft journals 4 and 6 have centers that are disposed in two different planes 9 and 11, which are spaced apart from each other and which extend vertically as well as being parallel to each other, as seen in FIG. 2. The second side frame 8 is shown only in FIG. 2. The two shaft journals 4 and 6 of each of the printing cylinders 1 and 2 are securely positioned in the side frames 7 and 8 and are supported for rotation by suitable bearings, as is shown schematically in FIG. 1. It will thus be understood that the printing cylinders 1 and 2 are generally fixed in their positions between the side frames 7 and 8.

A vertically shiftable carriage 12 or 13, each of which is height-adjustable in the direction of the arrow B, is disposed in the respective vertical plane 9 or 11 and respectively supports an end of an ink application roller, in particular a screen roller 14 or 16, on its shaft journals 17 or 18. Each screen roller 14 and 16 can be placed in contact with its associated printing cylinder 1 or 2 that is fixed on the frame. While the carriages 12 and 13 for each of the ink application rollers 14 and 16 is supported by the press side frames, it can be seen by referring to FIG. 1 that the shaft journals 17 and 18 of the ink application rollers 14 and 16 are not supported by the side frames 7 and 8. Thus the ink application rollers 14 and 16 are shiftable with respect to the side frames by movement of the carriages 12 and 13 and by rotation of eccentric support disks, as will be discussed shortly.

On its shaft journal 22, of which only the left shaft journal 22 is shown in a manner the same as with the other cylinders 1 and 2 and rollers 14 and 16, a counter-pressure cylinder 24 is disposed above the axes of rotation 19 and 21 of the printing cylinder 1 and 2 in a third, vertical plane 23. The circumference of the counter-pressure cylinder 24 can be selectively placed into contact with either one of the two printing cylinders 1 and 2. The third vertical plane 23 is located in the center between the two vertical planes 9 and 11 of the printing cylinders 1 and 2. The counter-pressure cylinder 24 is pivotably seated, by means of an eccentric bearing 25 on its shaft journals 22, in a holder 26 fixed on the frame. The counter pressure cylinder 24 is thus similar to the two ink application cylinders or screen rollers 14 and 16 in that it is not directly secured to the side frames 7 and 8 but is instead secured to holders 26 that are, in turn, secured to the side frames. The eccentric bearing 25 as well as eccentric disks, which will be discussed in detail shortly, are used to shift the counter-pressure cylinder 24 into contact with the desired one of the printing cylinders 1 and 2.

The printing cylinders 1 and 2 and the screen rollers 14 and 16 can be driven respectively, through their shaft journals 4, 6, 17, 18 and by gears, not shown. An ink application device, for example a chamber doctor blade 29 or 31, is disposed underneath each screen roller 14 or 16.

Each printing cylinder 1 and 2 has a pair of spaced support disks 33 and 49 or 34 and 52, respectively on its shaft journal 4 or 6. These support disks 33 and 49 or 34 and 52 are disposed concentrically on the shaft journals 4 and 6 with respect to the axes of rotation 19 and 21 of the printing cylinders 1 and 2. Preferably, each support disk 33, 49, 52, 34 consists of a ball bearing assembly, whose inner raceway has been pressed on the shaft journal 4 or 6 of the printing cylinder 1 or 2 and whose outer raceways function as a support disks. An inner raceway 35 and an outer raceway 40 are shown in the example of the concentric support disk 34 as may be seen in FIG. 2.

Between the holder 26 and an end face 36 of the counter-pressure cylinder 24, the shaft journal 22 of the counter-pressure cylinder 24 has two spaced support disks 37 and 38 placed axially adjacent each other in the axial direction of the counter-pressure cylinder 24. These two support disks 37 and 38 also consist of ball bearing assemblies that are not shown in detail. However, the outer raceway of each of these counter-pressure cylinder support disks has an eccentricity 27 or 28 with respect to the axis of rotation 39 of the counter-pressure cylinder 24.

The eccentricities 27 28 are embodied in a "sickle-shaped" manner which is the result of the difference of a radius r1 with respect to a radius r2 of the support disks 37 and 38, wherein r2 is greater than r1. It could also be said that the generating curve of the envelope of the support disks 37 and 38 has an eccentricity 27 or 28. In this preferred embodiment the support disk 37 closer to the end face of the counter-pressure cylinder 24 is aligned with the center support disk 33 of the left printing cylinder 1, as seen in FIG. 2, and a support disk 38 remote from the end face of the counter-pressure cylinder 24 is aligned with the center support disk 34 of the right printing cylinder 2.

On their circumferences, the eccentric support disks 37 and 38, that are placed on the shaft journal 22 of the counter-pressure cylinder 24, also have teeth 41 or 42. The teeth 41 formed on the periphery of the eccentric support disk 38 that is remote from the end face of the counter pressure cylinder 24 mesh with a gear wheel 43 of a drive motor 46, and the teeth 42 of the eccentric support disk 37 situated adjacent to the end face of the counter-pressure cylinder 24 mesh with a gear wheel 44 of a drive motor 47, which may be, for example, a servo motor. For reasons of improved clearness, the holder 26 for the counter-pressure cylinder 24 is only indicated by dashed lines below the gear wheels 43 and 44. It will thus be understood that rotation of the toothed gear wheels 43 and 44 will shift the position of the counter-pressure cylinder 24 or will change the contact pressure between the counter-pressure cylinder 24 and the one of the two printing cylinders 1 and 2 with which it is in contact. A rotation of the eccentric bearing 25 in the holder 26 will be effective to shift the counter-pressure cylinder 24 into contact with the selected one of the two printing cylinders 1 and 2.

The screen rollers 14 and 16 are located beneath their respective printing cylinders 1 and 2 and also have eccentric support disks 48 and 51 on their shaft journals 17 and 18. These are not represented in detail, but are analogous to the type described in connection with the eccentric support disks 37 and 38, which are provided on shaft journal 22 of counter-pressure cylinder 24. In this case, the eccentric support roller 48 placed on the shaft journal 17 of the screen roller 14 cooperates with a concentric support roller 49 placed on the shaft journal 4 of the printing cylinder 1 remote from the end face of cylinder 1. On the other side, an eccentric support disk 51 on the shaft journal 18 of the screen roller 16 cooperates with a concentric support disk 52 on the shaft journal 6 of the printing cylinder 2 in the vicinity of the side frame 7. There is an eccentricity 50 or 55 between the axes of rotation 53 and 54 of the screen rollers 14 and 16 and the support disks 48 and 51 on the sides of the support disks 48, 51 which face the printing cylinder 1, 2. There are also teeth 56 and 57 on the support disks 48 and 51. These teeth engage respectively with teeth on a gear wheel 58, 59, which is interlockingly connected with a drive motor 61 or 62. What was discussed above with respect to the eccentricity 27 and 28 also applies to the eccentricity 50 and 55.

The following polygon of forces is active in the operational state of the printing unit in accordance with the present invention, in which the counter-pressure cylinder 24 is brought into contact with the left printing cylinder 1 and the screen roller 14 is also brought into contact with the printing cylinder 1. The concentric support disk 33 on the shaft journal 6 of the printing cylinder 1 is frictionally engaged by the eccentrically engageable support disk 37 which is positioned on the shaft journal 22 close to the end face of the counter-pressure cylinder 24. Furthermore, the concentric support disk 49 of the printing cylinder 1 is frictionally engaged by the eccentric support disk 48 of the screen roller 14, so that in case of wear of a printing plate 3, which is not specifically shown on the printing plate cylinder 1, it is possible to perform an adjustment of the position of counter-pressure cylinder 24 as well as of the position of the screen roller 14 by increasing the eccentricity 27 and 28 of the support disks 37 and 48 after the drive motors 47, 61 have been switched on. Due to the fact that only two support disks 33 and 37, or 48 and 49 act in pairs against each other, only small rotational forces are required to perform the adjustment of the cylinders 14, 24 on the printing cylinder 1. In the course of this adjustment, the shaft journals 4, 17 and 22 of the cylinders 1, 14 and 24 respectively turn together with the inner raceways shown, for example, by the inner raceway 35 at the support disk 34, while the outer raceways (shown by means of the outer raceway 40 at the support disk 34) are placed on top of each other, such that they do not move when pressed against each other in pairs.

If now the right printing cylinder 2 is to be operated, the holder 26 is turned to the right by means of the eccentric bearing 25 as seen in FIG. 2, so that the circumference of the counter-pressure cylinder 24 now contacts the circumference of the printing cylinder 2. Furthermore, the eccentric support disk 38 of the counter-pressure cylinder 24 is frictionally engaged with the concentric support disk 34 of the printing cylinder 2. The concentric support disk 52, which is also located on the shaft journal 6 of the printing cylinder 2, is frictionally engaged with the eccentric support disk 51 of the right screen roller 16, so that only two support disks 38 and 34, or 52 and 51 act on each other. The easy adjustability of the counter-pressure cylinder 24 and the screen roller 16 with respect to printing cylinder 2 is thus provided. The teeth 41, 42, 56 and 57 of the support disks 38, 37, 48 and 51, respectively take up approximately 30 degrees of arc on the circumference of the respective outer raceways of the eccentric support disks. It will be understood that these eccentric support disks 38, 37, 48 and 51 undergo only a slight amount of rotation to change their eccentricities and to compensate for printing plate wear and the like. Once the carriages 12 or 13 have been used to position the screen rollers 14 or 16 in contact with the printing cylinders 1 or 2 and the holder 26 and the eccentric bearing 25 has been used to position the counter-pressure cylinder 24 in contact with the selected one of the two printing cylinders 1 or 2, the gear motors 46, 47, 61 or 62 can be operated to rotate the eccentric support disks 37, 38, 56 and 57, as necessary to adjust the position of the cylinders 14 and 16 and 24 to compensate for printing plate wear or other wear.

As was discussed previously, it is understood that the sides of the cylinders 1, 2, 14, 16, 24 with shaft journals, not shown in FIG. 1, are also provided with support disks, eccentric ones for engageable cylinders and concentric ones for cylinders fixed on the frame, as described above. The same applies to the drive elements for the eccentric support disks.

In accordance with the present invention, it is also possible to embody the concentric support disks 33, 34, 49, 52 in such a way that a segment of the circle is cut out of their circular shape on the right and left and the secants of the segments of the circles extend parallel to each other. These support disks 33, 34, 49, 52 are then secured against relative twisting by means of holding devices, not shown, fixed on the frame. The shaft journals 4, 6 are then seated, for example, in slide bearings of the concentric support disks 33, 34, 49, 52. This applies in a similar manner also to the embodiment of the support disks 48, 51, 37, 38.

While a preferred embodiment of a printing unit for a rotary printing press in accordance with the present invention has been set forth fully and completely hereinabove, it will be apparent to one of skill in the art that a number of changes in, for example the overall sizes and lengths of the cylinders, the specific drives for the cylinders, the number of printing plates secured to the peripheries of the printing cylinders and the like may be made without departing from the true spirit and scope of the present invention which is accordingly to be limited only by the following claims.

What is claimed is:

1. A printing unit for a rotary printing press comprising:

first and second printing cylinders, each of said first and second printing cylinders having shaft journals and being supported for rotation about an axis of rotation;

first and second printing cylinder support disks rotatably secured to said shaft journals of said first and second printing cylinders, said first and second printing cylinder support disks on each said shaft journal being concentric with said shaft journal;

first and second ink application rollers, said first and second ink application rollers each having shaft journals and each being supported for rotation about an axis of rotation;

an ink application roller support disk being rotatably secured to each said shaft journal for each of said first and second ink application rollers, each of said ink application cylinder support disks being eccentric about said axes of rotation of said first and second ink application rollers;

a counter-pressure cylinder supported for selective engagement with one of said first and second printing cylinders, said counter-pressure cylinder having shaft journals and being supported for rotation about an axis of rotation; and first and second counter-pressure cylinder support disks rotatably secured to each of said counter-pressure cylinder shaft journals, each of said first and second counter-pressure support disks being eccentric about said axis of rotation of said counter-pressure cylinder, said first counter-pressure cylinder support disk being engageable with said first printing cylinder support disk of said first printing cylinder and said second counter-pressure cylinder support disk being engageable with said first printing cylinder support disk of said second printing cylinder, said first ink application roller support disk being engageable with said second printing cylinder support disk of said first printing cylinder and said second ink application roller support disk being engageable with said second printing cylinder support disk of said second printing cylinder.

2. The printing unit of claim 1 wherein each of said first and second ink application rollers is supported for movement toward and away from its cooperating one of said first and second printing cylinders and further wherein each of said first and second ink application rollers has a chambered doctor blade associated with it.

3. The printing unit of claim 1 wherein said counter-pressure cylinder is supported for pivotal movement into said selective engagement with said first and second printing cylinders.

4. The printing unit of claim 1 wherein each of said first and second printing cylinders is provided with at least one flexible printing plate.

5. The printing unit of claim 1 wherein each of said first and second printing cylinder support disks on each of said journals of each of said first and second printing cylinders is a bearing assembly having an inner raceway secured to a respective said shaft journal and a concentric circular outer race.

6. The printing unit of claim 1 wherein each of said first and second eccentric counter pressure support disks and each of said eccentric ink application roller support disks is a bearing assembly having an inner raceway secured to a respective said shaft journal and having an eccentric outer race.

7. The printing unit of claim 6 wherein each said eccentric outer race has an outer surface portion with gear teeth and further including a drive element for each of said eccentric support disks, each said drive element including a drive motor and a toothed drive gear in engagement with said gear teeth.

* * * * *